United States Patent [19]

Tetreault

[11] Patent Number: 4,875,677

[45] Date of Patent: Oct. 24, 1989

[54] LEAD ARM STRAP FOR BASEBALL HITTERS

[76] Inventor: Albert G. Tetreault, 1541 Conejo La., Fullerton, Calif. 92632

[21] Appl. No.: 80,768

[22] Filed: Aug. 3, 1987

[51] Int. Cl.[4] ..... A61B 69/40

[52] U.S. Cl. ..... 273/26 C; 273/29 A; 128/77

[58] Field of Search ..... 273/26 R, 26 C, 29 R, 273/29 A, 35 R, 186 R, 189 R, 189 A, 54 B, 183 B, 191 B, 73 R; 128/77, 80 R, 80 B, 80 G, 80 E, 80 F, 87 R, 88, 83, 25, 133, 143; 124/23; 272/137, 132, 142, 143, 130

[56] References Cited

U.S. PATENT DOCUMENTS

| | | | |
|---|---|---|---|
| 3,858,881 | 1/1975 | Hurwitz | 273/29 R |
| 4,042,241 | 8/1977 | Collins | 273/411 |
| 4,559,932 | 12/1985 | Salort | 128/88 |
| 4,606,542 | 8/1986 | Segal | 272/137 |

*Primary Examiner*—Edward M. Coven
*Assistant Examiner*—T. Brown
*Attorney, Agent, or Firm*—Edgar W. Averill, Jr.

[57] ABSTRACT

A training aid for baseball hitters to assist in keeping a batter's lead arm flexed in a proper hitting stance. The training aid has a first cuff which attaches to the batter's forearm. A second cuff is attached to the batter's upper arm and one or more elastic straps are connected between the two cuffs.

6 Claims, 1 Drawing Sheet

15
12
11
16
10
13
14

14
13
19
18
21
10
29
17
15
16
30
22
23
12
24
25
11

31
13
32
33

11
34

LEAD ARM STRAP FOR BASEBALL HITTERS

BACKGROUND OF THE INVENTION

The field of the invention is sporting goods and the invention relates more particularly to training aids for baseball hitters.

The skill or art of hitting a baseball is a pastime which can often be significantly improved by a coach watching a batter and suggesting changes in the stance. It is generally impractical for a coach to be present for a large amount of time and, thus, there is a need for a batting aid which can operate in the absence of a coach.

SUMMARY OF THE INVENTION

It is an object of the present invention to provide a process for using a training aid for baseball hitters which may be useful by a hitter without the presence of a coach.

The present invention is for a process for using a training aid for baseball hitters to assist in keeping a batter's lead arm flexed in a hitting stance. The aid has a first cuff for attachment to the batter's forearm. The first cuff has a quick connect and disconnect attachment means such as a hook and eye attachment means. A second cuff is attachable around a batter's upper arm. Elastic strap means are affixed between the first and second cuffs. The elastic strap means is of a length to hold the batter's lead arm in a generally "L" shaped position when the cuffs are attached around a batter's forearm and the elastic strap is affixed between them. The elastic strap is of sufficient stiffness to hold the baatter's lead arm in its "L" shaped position but, nonetheless, has sufficient elsticity to permit the batter's lead arm to be extended during a swing. Preferably, there are two such elastic straps and they may be detachable from one or both of the cuffs. The process of the present invention includes the steps of attaching a first cuff to a batter's lead arm forearm, attaching a second cuff to a batter's lead arm upper arm and affixing elastic strap means between the first and second cuff.

DESCRIPTION OF THE PREFERRED EMBODIMENTS

Figure 1:
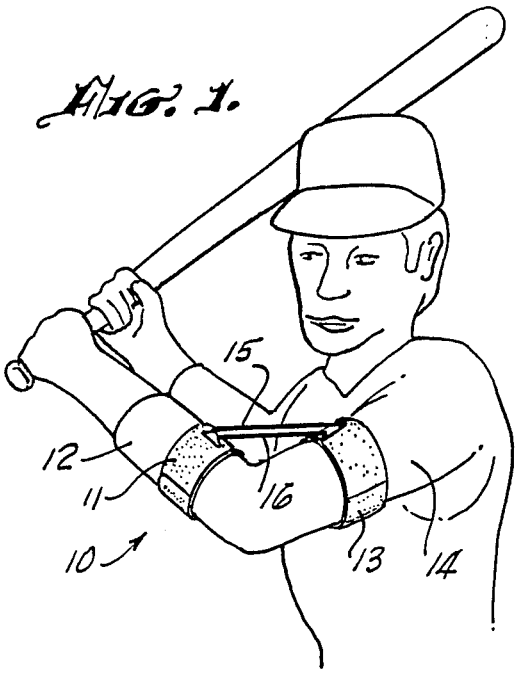
FIG. 1 is a perspective view of the training aid affixed to the lead arm of a baseball hitter in a hitting stance.

The training aid for baseball hitters is shown in perspective view in FIG. 1 and indicated generally by reference character 10. Aid 10 has a first cuff 11 wrapped around the batter's forearm 12. It also has a second cuff 13 wrapped around the batter's upper arm 14. A pair of elastic straps 15 and 16 are connected between the first and second cuffs and, as shown in FIG. 1, are tight when the batter's lead arm is in a generally "L" shaped position. Batters often tend to hold the lead arm too straight and this training aid is capable of reminding a batter that his lead arm should be in a generally "L" shaped position.

Figure 2:
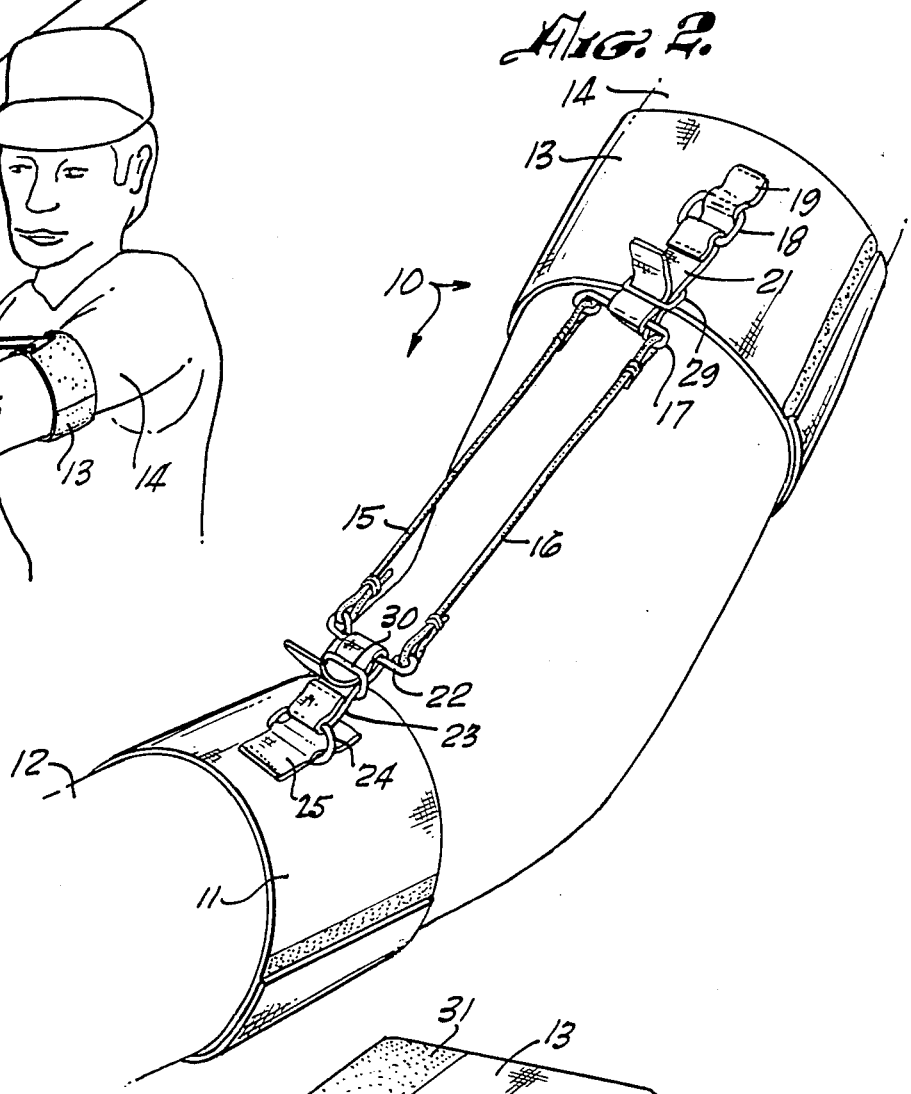
FIG. 2 is an enlarged perspective view of the two cuffs and elastic strap means affixed therebetween of the training aid of FIG. 1.
Figure 3:
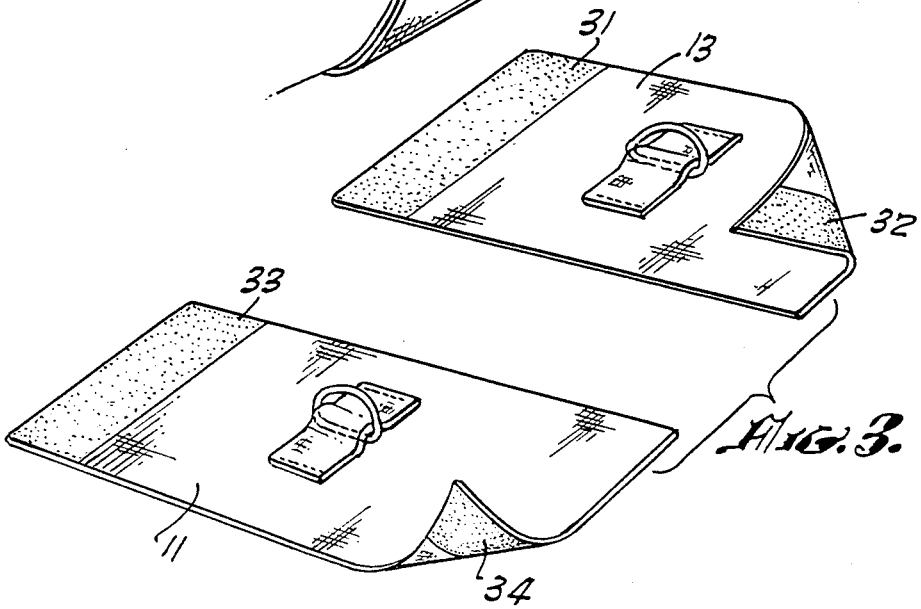
FIG. 3 is a top plan view of the two cuffs of the training aid of FIG. 1.

The details of construction of the cuffs and elastic straps are shown in FIGS. 2 and 3. In FIG. 2, it can be seen that strap 15 is affixed to arm 17. Arm 17 is held by a strap 21 to a metal ring 18 held to the face of cuff 13 by a strap 19 sewn thereto. Similarly, elastic strap 16 is also held to arm 17. The other ends of straps 15 nd 16 are held by arm 22 which, in turn, is held to cuff 11 by strap 23, ring 24 and strap 25. Adjustable clamps 29 and 30 permit the adjustment of the length of the elastic strap assembly depending upon the desired position of the lead arm.

FIG. 3 shows the preferred attachment means of the first and second cuffs which comprise hook and loop material of the type commonly sold under the trademark "Velcro." Hook material 31 is sewn, or otherwise affixed, to the face of cuff 13 and loop material 32 is secured to the back side of cuff 13 so that it may be readily wrapped around the upper arm. Similarly, hook material 33 is held to the face of cuff 1 and loop maaterial 34 is held to the bck surface of the opposite end.

It is preferable, although not essential, that the elastic strap assembly be adjustable in length. In FIG. 2, the elastic straps 15 and 16 are held by straps 21 and 33 which are adjustable in length. It is also possible that each end of the elastic strap merely has a spring clip or other attachment means affixed to one or two rings sewn to the cuffs.

The material of construction of the elastic straps forms an important part of the present invention. The elastic strap should be stiff enough to readily remind the batter when stretching of the strap begins. That is, in the preferred "L" shaped position, the strap should be tight but not yet stretched. Thus, any movement past the "L" shaped position shsould be easily felt by the batter. On the other hand, during a swing, it is necessary that the straps become extended and, thus, they should have sufficient elasticity to permit extension of the forearm during a swing without undue discomfort to the batter. Typically, a strap of approximately four inches in length would be required to stretch to approximately twice that length during a swing and the amount of force required for this stretch should not exceed about 25 pounds.

In use, the training aid is affixed to the batter's arm during batting practice and after a relatively short practice period, the batter is quickly reminded of the proper forearm position. While the batting aid shown in the drawings has two elastic straps, it is possible that a single strap be used. Also, while both ends of the elastic strap may be removed from the cuff, it is also contemplated that the elastic straps permanently affixed, such as by sewiing to one or both of the cuffs.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A training aid for baseball hitters to assist in keeping a batter's lead arm flexed in a hitting stance, said aid comprising:

a first cuff attached to a batter's lead arm forearm, said cuff having quick connect and disconnect attachment means around the forearm;

a second cuff attached to a batter's lead arm upper arm, said cuff having quick connect and disconnect attachment means around the upper arm; and elastic strap means affixed between said first cuff and said second cuff by attachment means, said elastic strap means being of a unstretched length and stiffness to hold a batter's lead arm in a generally "L" shaped position when the cuffs are attached around the batter's forearm and upper arm, and when the arm is in a substantially relaxed state but having sufficient elasticity to permit the lead arm to be straightened during a swing without discomfort, said elastic strap means being attached only between that portion of the cuff which is positioned around the inner part of the batter's lead arm so that the lead arm tends to be restrained upon extension.

2. The training aid for baseball hitters of claim 1 wherein there are two elastic strap means.

3. The training aid for baseball hitters of claim 1 wherein the quick connect and disconnect attachment means comprises a hook and eye attachment means.

4. The training aid for baseball hitters of claim 1 wherein the said attachment means between said elastic strap means and said cuffs is adjustable.

5. A training aid for baseball hitters to assist in keeping a batter's lead arm flexed in a hitting stance, said aid comprising:

a first cuff attached to a batter's lead arm forearm, said cuff having hook and eye attachment means around the forearm, and said first cuff having ring means affixed to the face thereof;

a second cuff attached to a batter's lead arm upper arm, said cuff having hook and eye attachment means around the upper arm, said second cuff having ring means affixed to the face thereof; and two elastic strap means affixed between said ring means on said first cuff and said ring means on said second cuff, said elastic strap means being of a unstretched length and stiffness to hold a batter's lead arm in a generally "L" shaped position when the cuffs are attached around the batter's forearm and upper arm and when the arm is in a substantially relaxed state but having sufficient elasticity to permit the lead arm to be straightened during a swing without discomfort, said training aid having no elastic straps along the outer periphery thereof.

6. The training aid for baseball hitters of claim 5 wherein each of said cuffs is about three inches wide.

* * * * *